US006902420B2

(12) United States Patent
Muro et al.

(10) Patent No.: US 6,902,420 B2
(45) Date of Patent: Jun. 7, 2005

(54) CONNECTOR LOCK STRUCTURE

(75) Inventors: Takashi Muro, Haibara-gun (JP); Kaoru Matsumura, Haibara-gun (JP); Nobuyuki Sakamoto, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/786,394

(22) Filed: Feb. 26, 2004

(65) Prior Publication Data

US 2004/0166717 A1 Aug. 26, 2004

(30) Foreign Application Priority Data

Feb. 26, 2003 (JP) ..... P.2003-049243

(51) Int. Cl.[7] ..... H01R 13/627
(52) U.S. Cl. ..... 439/358
(58) Field of Search ..... 439/358, 357, 439/350

(56) References Cited

U.S. PATENT DOCUMENTS 4,801,275 A 1/1989 Ikeda et al.
6,146,183 A 11/2000 Jinno et al.
6,343,948 B1 * 2/2002 Nutzel ..... 439/358
6,579,113 B2 * 6/2003 Kodama ..... 439/358
2004/0005805 A1 * 1/2004 Shibata ..... 439/358

FOREIGN PATENT DOCUMENTS

EP 1 133 019 A2 9/2001
EP 1 189 313 A2 3/2002
JP 2000-150069 A 5/2000

* cited by examiner

*Primary Examiner*—Phuong Dinh
(74) *Attorney, Agent, or Firm*—Sughrue Mion, PLLC

(57) ABSTRACT

A connector lock structure includes a first connector housing, a second connector housing which is fitted to the first connector housing, a flexible lock member which is frontwardly extended from the first connector housing along a connector fitting direction and which has an engagement portion provided at an end portion thereof, a latch member which is provided on the second connector housing and which is engaged with the engagement portion, an operating arm which upwardly protrudes from the end portion of the lock member and rearwardly extends and which has a operation portion provided at a rear end portion thereof, and a fulcrum projection which is provided on at least one of an outer wall face of the lock member and a bottom surface of the operating arm facing the outer wall face.

5 Claims, 4 Drawing Sheets

CONNECTOR LOCK STRUCTURE

BACKGROUND OF THE INVENTION

This invention generally relates to a connector lock structure, and more particularly to a connector lock structure having a mechanism for releasing a locked condition of connector housings.

Hitherto, there has been a lock structure shown in FIGS. 5 and 6 (see, for example, JP-A-2000-150069), which serves as a structure for connecting male and female connector housings to each other, for locking this connected condition, and for releasing this locked condition.

The lock structure shown in FIGS. 5 and 6 is configured so that a lock portion 1 having a lock arm 3 and a releasing arm 5 is formed integrally with the female connector housing.

As shown in FIG. 6, the lock arm 3 includes two curved leg portions 3*a* formed in such a way as to upwardly protrude and extend from an outer wall 7, two arm portions 3*b* respectively and horizontally extending from the two leg portions 3*a* along a connector fitting direction toward a latch portion of a counterpart connector, and an engaging portion 3*c* which is formed in such a manner as to connect ends of the two arm portions 3*b* to each other and has a locking claw 3*d*.

As shown in FIG. 6, the releasing arm 5 includes two leg portions 5*a* and two arm portions 5*b*. The two leg portions 5*a* upwardly protrudes and extends from the outer wall 7 and are thinner than the leg portions 3*a*. The two arm portions 5*b* is respectively formed on the two leg portions 5*a*. Each of the two leg portions 5*a* is formed at an outer side of an associated one of the leg portions 3*a* and at nearly the same position as that of the associated leg portion 3*a*.

The arm portions 5*b* are formed so that end parts thereof extend in a direction opposite to the engaging portion 3*c* and are connected to each other to thereby form the releasing portion 5*c*, and that the other end parts thereof extend toward and are connected to the engaging portion 3*c*.

In a case of releasing the locked condition of the lock portion 1, the releasing portion 5*c* is depressed in the direction of an arrow A as shown in FIG. 6. The releasing arm 5 turns in response to a force exerted on the releasing portion 5*c* so as to surely upwardly and pivotally move the engaging portion 3*c* in the direction of an arrow B around each of the leg portions 5*a*. As a result, the locking claw 3*d* is disengaged from the latch portion of the counterpart connecter (not shown) to release the locked condition.

Because the releasing arm 5 has the leg portions 5*a*, the engaging portion 3*c* surely displaces in a lock releasing direction B in response to a force applied to the releasing portion 5*c* regardless of a direction and an angle of application of the force. Consequently, cancellability of the structure is enhanced.

However, in the case of the lock structure of the related lock portion 1, when the engaging portion 3*c* is engaged with and disengaged from the latch portion of the counterpart connector, the lock arm 3 and the releasing arm 5 swing around the leg portions 3*a* and 5*a* protruding upwardly from the outer wall 7 of the connector housing, respectively.

Thus, bending stresses are apt to be concentrated at bent portions k1 at each of which an associated one of the leg portions 3*a* intersects with an associated one of the arm portions 3*b*, bent portions k2 at each of which an associated one of the leg portions 5*a* intersects with an associated one of the arm portions 5*b*, and corner portions k3 and k4 at which the leg portions 3*a* and 5*a* continued to the outer wall 7 of the connector housing, respectively. Fatigue due to stress concentration in the leg portions 3*a* and 5*a* may result in permanent deflections thereof and may cause reduction in an engaging strength of the engaging portion 3*c*, or fatigue destruction thereof.

In the lock structure of the related lock portion 1, a position, at which the engaging portion 3*c* of the lock arm 3 is equipped, is away from the outer wall 7 of the connector housing by a height h of each of the leg portions 3*a*. Thus, the lock structure of the related lock portion 1 has a problem in that the size of the connector housing increase owing to increase in the dimension of the outside diameter of the connector housing, which is caused by outward protrusion of the engaging portion 3*c*.

SUMMARY OF THE INVENTION

It is therefore an object of the present invention to provide a connector lock structure enabled to maintain a stable engaging strength over a long time and also enabled to prevent increase in the outside dimension thereof in size.

In order to achieve the above object, according to the present invention, there is provided a connector lock structure, comprising:

a first connector housing;

a second connector housing, which is fitted to the first connector housing;

a flexible lock member, which is frontwardly extended from the first connector housing along a connector fitting direction, and which has an engagement portion provided at an end portion thereof;

a latch member, which is provided on the second connector housing, and which is engaged with the engagement portion;

an operating arm, which upwardly protrudes from the end portion of the lock member and rearwardly extends, and which has a operation portion provided at a rear end portion thereof; and a fulcrum projection, which is provided on at least one of an outer wall face of the lock member and a bottom surface of the operating arm facing the outer wall face.

Preferably, the flexible lock member is formed by a part of an outer wall of the first connector housing. The fulcrum projection is provided on at least one of an outer wall face of the first connector housing and the bottom surface of the operating arm facing the outer wall face of the first connector housing.

Preferably, when the operating portion is depressed, the operating arm pivotally swing around the fulcrum projection as a fulcrum so as to deform the end portion of the lock member upwardly so that an engagement between the latch member and the engagement portion is released.

Preferably, a presser portion is provided on at least one of the lock member and the operating arm. A preventing member is provided on an outer face of the first connector housing, and engages with the presser portion so as to prevent the lock member from lifting.

In the above configurations, in a case where the locked condition of the engaging portion provided at an end portion of the flexible lock member and the latch member of the second connector housing is canceled, when the operation portion provided at the rear end portion of the operating arm is depressed, the operating arm pivotally swing around the fulcrum projection placed on the bottom thereof, so that the end of the operating arm upwardly moves.

Then, when the end of the operating arm upwardly moves, an upward force acts upon an end portion of the flexible lock member to which the end portions of the operating arm are connected. Thus, the end portion of the flexible lock member is upwardly bending-deformed. Consequently, the engaging portion provided at the end portion of the flexible lock member disengages from the latch member of the second connector housing.

That is, when the engagement between the engaging portion and the latch member of the second connector housing is canceled, the operating arm pivotally swing around the fulcrum projection. Moreover, when the engaging portion engages with and disengages from the latch member of the second connector housing, the entire flexible lock piece is bending-deformed like a cantilever, an end of which is a free end. Thus, there are no leg portions similar to those, at which stress concentration is apt to occur, in the related lock structure.

Thus, the lock member according to the invention can prevent occurrences of permanent deflection resulted from fatigue due to stress concentration. Consequently, the lock structure can obtain excellent durability that enables the connector to maintain a stable engaging strength over a long time.

Further, the flexible lock member is frontwardly extended from the front end of the step-like part of the upper wall of the first connector housing along the connector fitting direction. Thus, the lock structure does not need leg portions that upwardly protrude from the outer wall surface of the first connector housing. Consequently, the connector can be designed so that the position, at which the engaging portion of the flexible lock member is provided, can be adjusted to the position of the upper wall of the first connector housing.

Thus, the lock structure can suppress the flexible lock member and the operating arm from protruding upwardly from the outer wall surface of the first connector housing. Consequently, the lock structure according to the invention can prevent the outside dimension of the first connector housing from increasing owing to the protrusion of the flexible lock member and the operating arm. Thus, the miniaturization of the connector can be achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereinafter, a connector lock structure according to an embodiment of the invention is described in detail with reference to the accompanying drawings.

Figure 1:
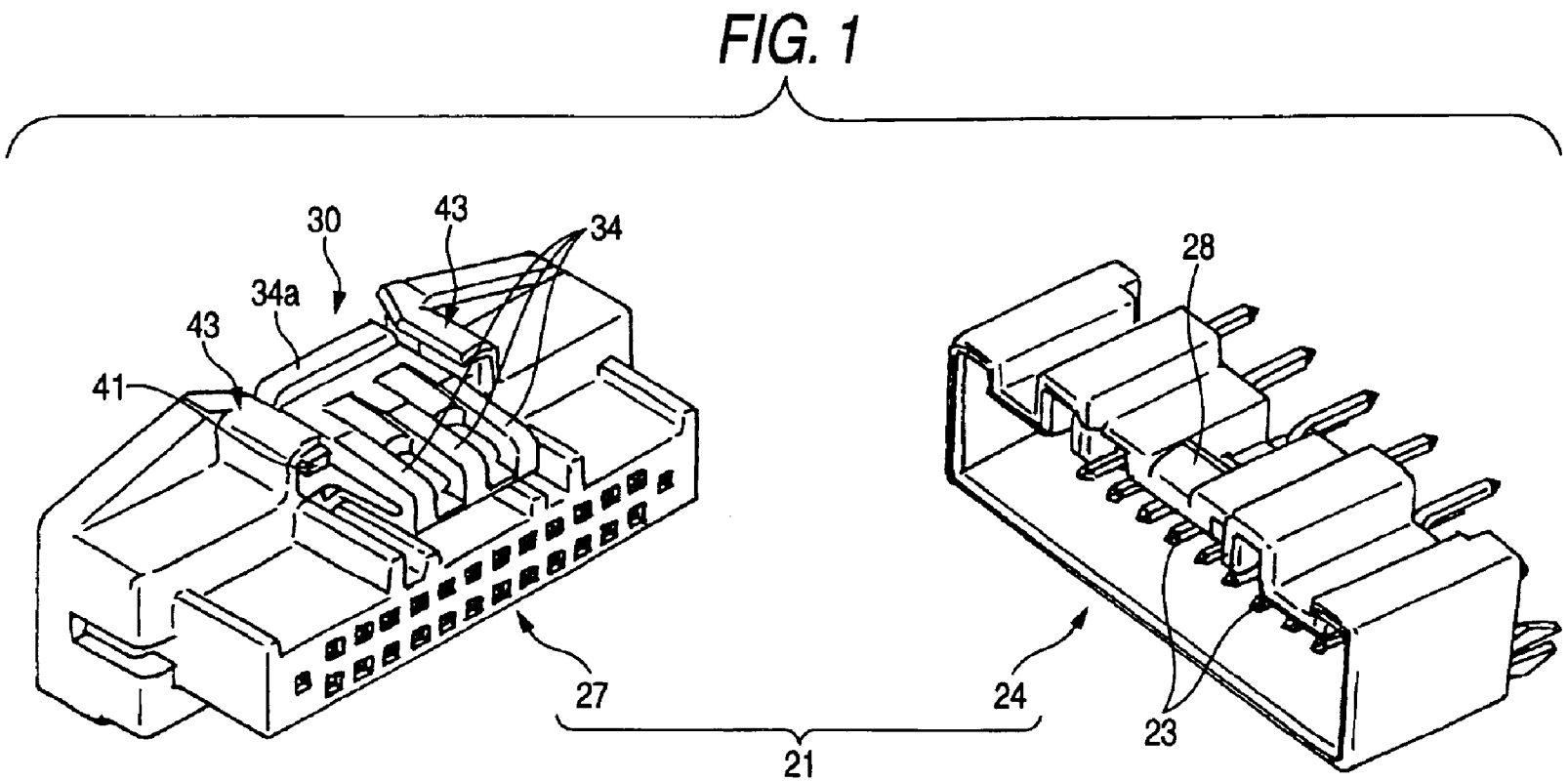
FIG. 1 is a perspective view illustrating a connector employing a connector lock structure according to an embodiment of the invention.
Figure 2:
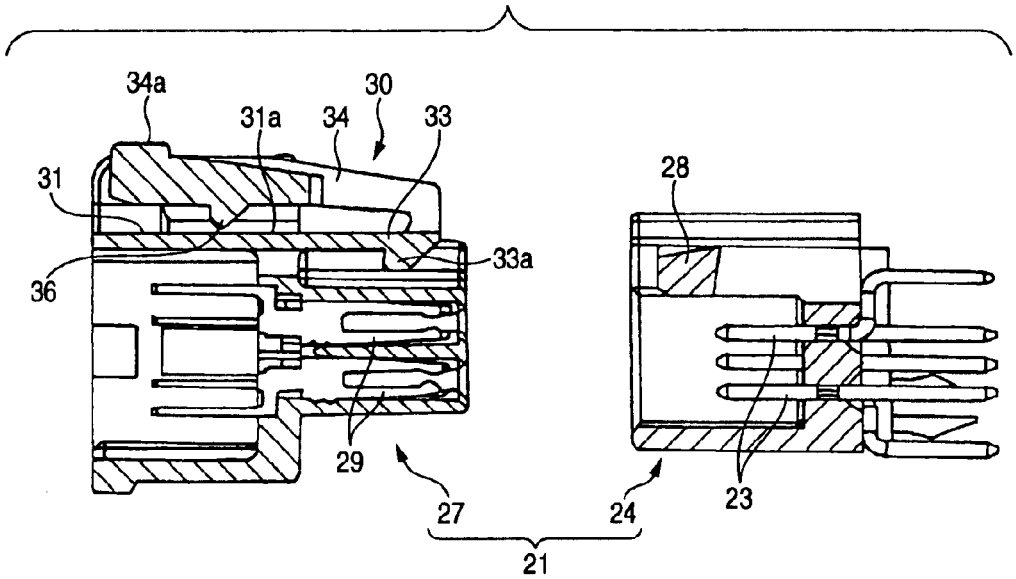
FIG. 2 is a longitudinally sectional view illustrating the connector shown in FIG. 1.
Figure 3:
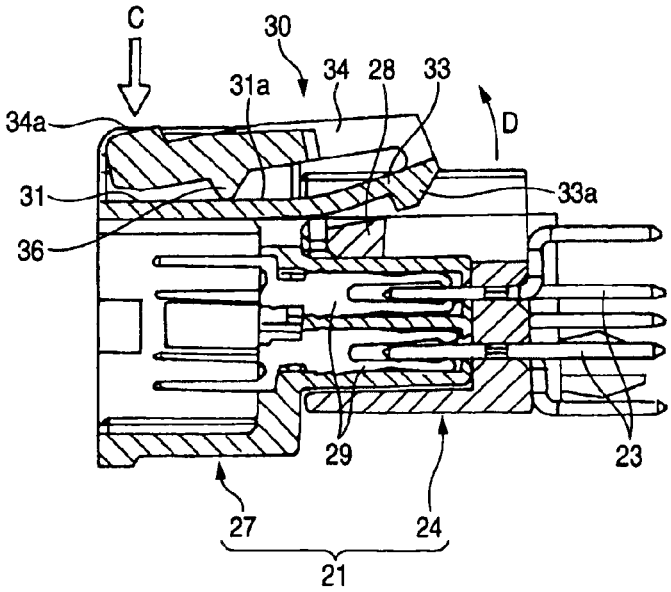
FIG. 3 is a longitudinally sectional explanatory view illustrating releasing of the locked condition of the connector shown in FIG. 2.
Figure 4:
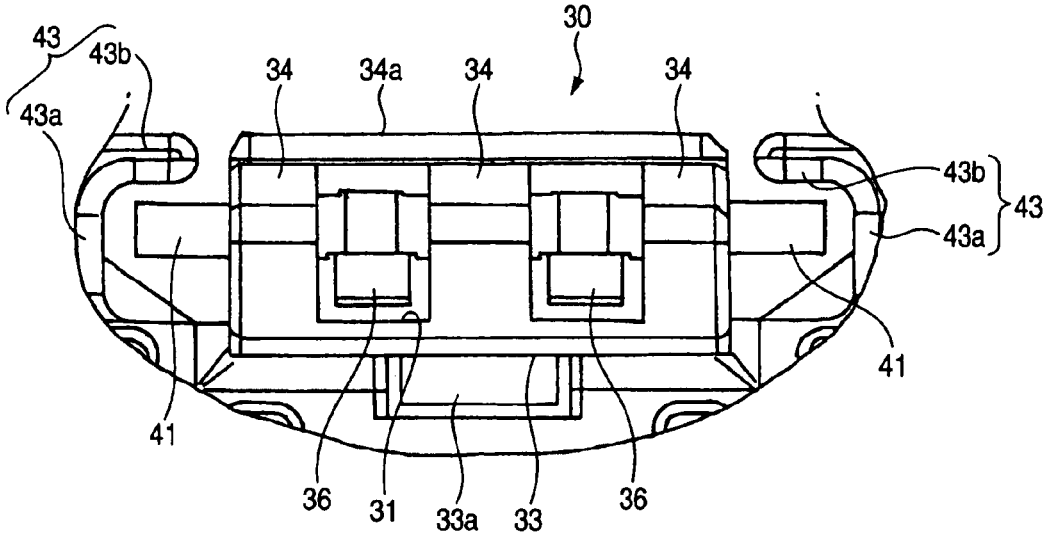
FIG. 4 is a front view illustrating a lock portion shown in FIG. 1.
Figure 5:
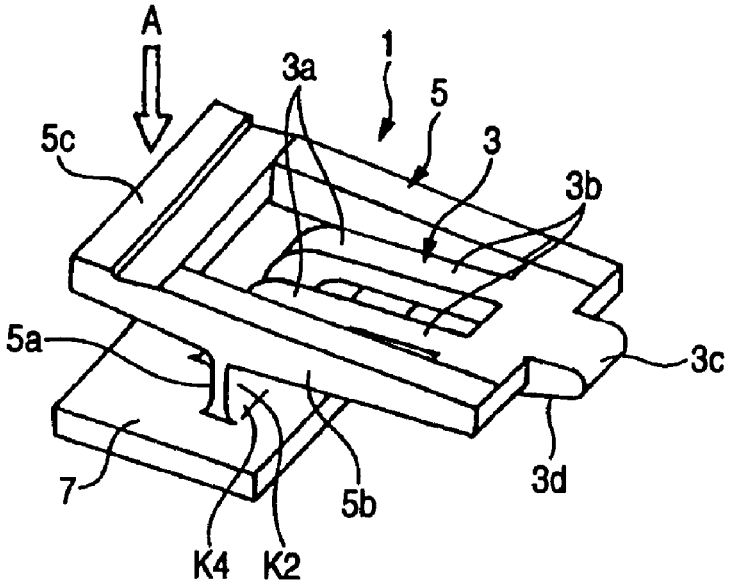
FIG. 5 PRIOR ART
FIG. 5 is a perspective view illustrating a related connector lock structure.
Figure 6:
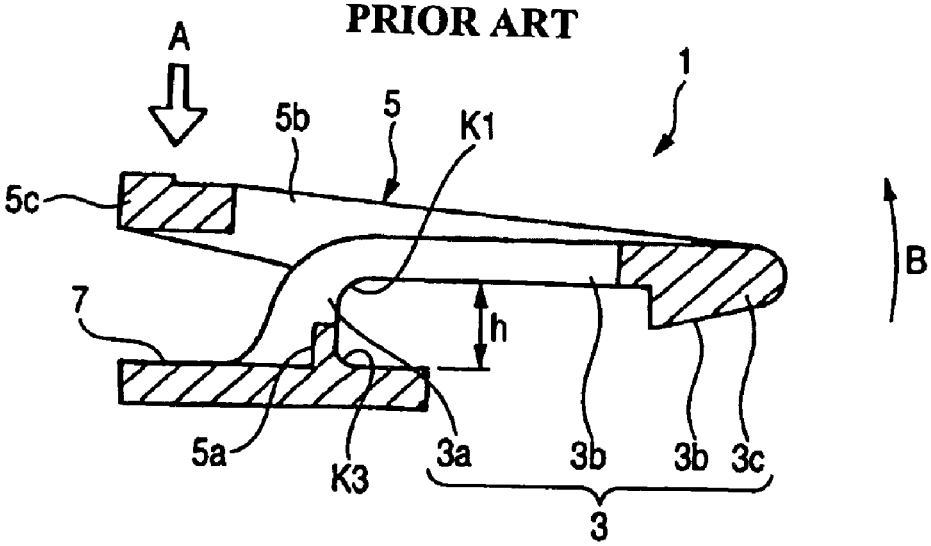
FIG. 6 PRIOR ART
FIG. 6 is a longitudinally sectional view illustrating the connector lock structure shown in FIG. 5.

FIG. 1 is a perspective view illustrating a connector employing a connector lock structure according to an embodiment of the invention. FIG. 2 is a longitudinally sectional view illustrating the connector shown in FIG. 1. FIG. 3 is a longitudinally sectional explanatory view illustrating releasing of the locked condition of the connector shown in FIG. 2. FIG. 4 is a front view illustrating a lock portion shown in FIG. 1.

As shown in FIGS. 1 and 2, a connector 21 according to this embodiment includes a female connector housing 24, which accommodates and holds a plurality of male terminal metal fittings 23, and also includes a male connector housing 27, which accommodates and holds a plurality of female terminal metal fittings 29.

When the female connector housing 24 and the male connector housing 27 are fitting-connected to each other, the connector lock structure according to this embodiment locks these connector housings each other by engaging a lock portion 30 provided on an outer (or upper) wall of the male connector housing 27 with an engaging portion 28 provided on an outer (or lower) wall of the female connector housing (or counterpart connector housing) 24.

As shown in FIGS. 1 and 2, the lock portion 30 has a flexible lock piece 33, three operating arms 34 and a pair of fulcrum projections 36. The flexible lock piece 33 is frontwardly extended from a front end of a step-like part of the upper wall 31 of the male connector housing 27 along a connector fitting direction (the rightward direction, as viewed in FIG. 2) and has an engaging portion 33*a* that is engaged with a latch portion 28 of the female connector housing 24 and provided at an end portion thereof. The three operating arms 34 upwardly protrudes from the end portion of the flexible lock piece 33 and rearwardly extends and has a pushing operation portion 34*a* provided at a rear end portion thereof. Each of the pair of fulcrum projections 36 is provided in such a way as to project toward an outer wall surface 31*a* of the male connector housing 27 from the bottom surface of a middle part of each of the operating arms 34 facing the outer wall surface 31*a*.

Moreover, as shown in FIGS. 1 and 4, in the case of this embodiment, a flat-plate-like presser piece 41 on a place close to a rear end of each of both the outer side faces of a set of the operating arms 43 in such a way as to horizontally project therefrom. Rise preventing members 43 to be engaged with the presser pieces 41 are provided on both the outer wall surface 31*a* of the male connector housing 27 so as to prevent a rising of the operating arms 34.

As shown in FIG. 4, each of the rise preventing members 43 includes a support wall 43*a*, which upwardly protrudes from the outer wall surface 31*a* of the upper wall 31, and a presser portion 43*b* protruding upwardly from the top of this support wall 43*a* and extending nearly horizontally above an associated one of the presser pieces 41. The rise preventing member 43 regulates the rising of the operating arms 34 thereby to prevent the flexible lock piece 33 from upwardly being bending-deformed.

Next, an operation of the lock structure of such a configuration is described hereinbelow.

When the female connector housing 24 and the male connector housing 27 are connected to each other, the engaging portion 33*a* provided at an end portion of the flexible lock piece 33 is upwardly pushed by the latch portion 28 of the female connector housing 24.

Consequently, the flexible lock piece 33 is upwardly bending-deformed, so that the engaging portion 33*a* climbs over and engages with the latch portion 28. Thus, the connected condition of the connector housings of the connector 21 is locked.

In a case where the connector housings of the connector 21 are disconnected from each other by releasing the locked condition of the engaging portion 33*a* of the flexible lock piece 33 and the latch portion 28 of the female connector housing 24, the pushing operation portion 34*a* provided at the rear end portion of each of the operating arms 34 is depressed in the direction of an arrow C.

Then, the fulcrum projections 36 disposed on the bottom of a set of the operating arms 34 abut against the outer wall surface 31*a* of the upper wall 31. The operating arms 34 pivotally swing around the fulcrum projections 36, so that the end of each of the operating arms 34 upwardly moves (in the direction of the arrow C).

When the end of each of the operating arms 34 upwardly moves, an upward force acts upon an end portion of the flexible lock piece 33 to which the end portions of the operating arms 34 are connected. Thus, the end portions of the flexible lock piece 33 are upwardly bending-deformed. Consequently, the engaging portion 33*a* provided at the end portion of the flexible lock piece 33 disengages from the latch portion 28 of the female connector housing 24.

When the engaging portion 33*a* is released from the latch portion 28 of the female connector housing 24, the operating arms 34 pivotally swing around the fulcrum projections 36. Moreover, when the engaging portion 33*a* engages with and disengages from the latch portion 28 of the female connector housing 24, the entire flexible lock piece 33 is bending-deformed like a cantilever, an end of which is a free end. Thus, there are no leg portions like those 3*a* and 5*a*, at which stress concentration is apt to occur, in the related lock structure.

The lock portion 30 can prevent occurrences of permanent deflection resulted from fatigue due to stress concentration. Consequently, the lock structure can obtain excellent durability that enables the connector to maintain a stable engaging strength over a long time.

Moreover, the flexible lock piece 33 is frontwardly extended from the front end of the step-like part of the upper wall 31 of the male connector housing 27 along the connector fitting direction. Thus, the lock structure does not require leg portions that upwardly protrude from the outer wall surface 31*a* of the connector housing 27. Consequently, the connector can be designed so that the position, at which the engaging portion 33*a* of the flexible lock piece 33 is provided, can be adjusted to the position of the upper wall 31 of the male connector housing 27.

The lock structure can suppress the flexible lock piece 33 and the operating arms 34 from protruding upwardly from the outer wall surface 31*a* of the male connector housing 27. Consequently, the lock structure according to the invention can prevent the outside dimension of the male connector housing 27 from increasing owing to the protrusion of the flexible lock piece 33 and the operating arms 34. Thus, the miniaturization of the connector 21 can be achieved.

Further, the rise preventing members 43 engaged with the presser pieces 41 of a set of the operating arms 34 for preventing the rise of the operating arms 34 are provided on the outer wall surface 31*a* of the male connector housing 27 in the lock portion 30 of this embodiment.

Thus, even when, for example, a bite-in of foreign matters to the lock portion 30 occurs and an external force is applied thereto in a direction in which an end portion of the flexible lock piece 33 is lifted, during a state in which the female connector housing 24 and the male connector housing 27 are locked, the rise preventing members 43 engage with the presser pieces 41 of a set of the operating arms 34, so that the flexible lock piece 33 can be prevented from being upwardly bending-deformed.

That is, the flexible lock piece 33 is prevented from being improperly upwardly (that is, in a direction in which the locked condition is canceled) bending-deformed. Thus, an undesirable releasing of the locked condition of the connector housings can be prevented. Connectors can be prevented from being broken due to excessive deformation thereof. Consequently, the lock portion 30 can enhance reliability of the lock.

Incidentally, the configurations of the connector housing, the counterpart connector housing, the flexible lock piece, the operating arms and the fulcrum projections according to the connector lock structure of the invention are not limited to those of the embodiment. Needless to say, such constituent elements may have various configurations without departing from the spirit of the invention.

For example, although the fulcrum projections 36 are provided on the bottom surface of the operating arms 34 in the embodiment, the fulcrum projections may be provided on the outer wall surface 31*a* of the male connector housing 27, which faces the bottom surface of the set of the operating arms 43, in such a way as to project therefrom. It is sufficient that the fulcrum projections 36 are provided on at least one of the outer wall surface 31*a* of the male connector housing 27 and the bottom surface of the operating arms 43, which face each other.

What is claimed is:

1. A connector lock structure, comprising:

a first connector housing;

a second connector housing, which is fitted to the first connector housing;

a flexible lock member, which is frontwardly extended from the first connector housing along a connector fitting direction, and which has an engagement portion provided at an end portion thereof;

a latch member, which is provided on the second connector housing, and which is engaged with the engagement portion;

an operating arm, which upwardly protrudes from the end portion of the lock member and rearwardly extends, and which has an operation portion provided at a rear end portion thereof; and a fulcrum projection, which is provided on at least one of an outer wall face of the lock member and a bottom surface of the operating arm facing the outer wall face.

2. The connector lock structure as set forth in claim 1, wherein the flexible lock member is fanned by a part of an outer wall of the first connector housing; and wherein the fulcrum projection is provided on at least one of an outer wall face of the first connector housing and the bottom surface of the operating arm facing the outer wall face of the first connector housing.

3. The connector lock structure as set forth in claim 1, wherein when the operation portion is depressed, the operating arm pivotally swing around the fulcrum projection as a fulcrum so as to deform the end portion of the lock member upwardly so that an engagement between the latch member and the engagement portion is released.

4. The connector lock structure as set forth in claim 1, wherein a presser portion is provided on at least one of the lock member and the operating arm;

wherein a preventing member is provided on an outer face of the first connector housing, and engages with the presser portion so as to prevent the lock member from lifting.

5. The connector lock structure as set forth in claim 1, wherein when the operating arm is operated for releasing an engagement between the latch member and the engagement portion, the fulcrum projection is in contact with an outer wall of the first connector housing.

* * * * *